US008851960B2

(12) United States Patent
Ikuta

(10) Patent No.: US 8,851,960 B2
(45) Date of Patent: Oct. 7, 2014

(54) ROTARY TOOL

(75) Inventor: Hiroki Ikuta, Anjo (JP)

(73) Assignee: Makita Corporation, Anjo-shi (JP)

( * ) Notice: Subject to any disclaimer, the term of this patent is extended or adjusted under 35 U.S.C. 154(b) by 335 days.

(21) Appl. No.: 13/295,418

(22) Filed: Nov. 14, 2011

(65) Prior Publication Data

US 2012/0129435 A1 May 24, 2012

(30) Foreign Application Priority Data

Nov. 16, 2010 (JP) ..... 2010-256052

(51) Int. Cl.
*B25F 5/00* (2006.01)

(52) U.S. Cl.
CPC ..... *B25F 5/006* (2013.01)
USPC ..... 451/359; 451/353; 451/357

(58) Field of Classification Search
CPC ..... B25F 5/006; B24B 23/00; B24B 23/03; A63H 33/046
USPC ..... 451/359, 357, 353, 270, 271
See application file for complete search history.

(56) References Cited

U.S. PATENT DOCUMENTS

| | | | | | |
|---|---|---|---|---|---|
| 2,102,053 | A * | 12/1937 | Batzer | 451/478 |
| 2,303,531 | A * | 12/1942 | Eyster | 451/357 |
| 2,338,509 | A * | 1/1944 | Hall et al. | 451/431 |
| 3,443,399 | A * | 5/1969 | Pope et al. | 464/7 |
| 3,572,677 | A * | 3/1971 | Damon | 267/281 |
| 3,584,857 | A * | 6/1971 | Hipsher | 267/281 |
| 3,731,556 | A * | 5/1973 | Decker | 74/571.1 |
| 4,002,327 | A * | 1/1977 | Damon | 267/281 |
| 4,507,895 | A * | 4/1985 | Sakata et al. | 451/213 |
| 5,235,716 | A * | 8/1993 | Stella | 15/23 |
| 5,678,641 | A | 10/1997 | Manschitz et al. | |
| 6,548,927 | B2 * | 4/2003 | Takahashi et al. | 310/82 |
| 8,465,010 | B2 * | 6/2013 | Kuki et al. | 267/293 |
| 2006/0214341 | A1 * | 9/2006 | Sugiura et al. | 267/293 |

FOREIGN PATENT DOCUMENTS

| | | | |
|---|---|---|---|
| GB | 2271736 | A * | 4/1994 |
| GB | 2415651 | A | 1/2006 |
| JP | A-62-074564 | | 4/1987 |

OTHER PUBLICATIONS

Jun. 25, 2014 Search Report issued in European Patent Application No. 11189125.5.

* cited by examiner

*Primary Examiner* — Lee D Wilson
*Assistant Examiner* — Tyrone V Hall, Jr.
(74) *Attorney, Agent, or Firm* — Oliff PLC

(57) ABSTRACT

A hand-held rotary tool is provided which can offer improved usability while realizing reduction of vibration of a tool body. The rotary tool has a tool body, a drive shaft disposed in the tool body, a driven shaft to which a tool bit is attached, an Oldham's coupling that transmits rotation of the drive shaft to the driven shaft, and an elastic element disposed between the driven shaft and the tool body. The driven shaft is prevented from moving in a longitudinal direction of the driven shaft relative to the tool body and allowed to move in a direction transverse to the longitudinal direction of the driven shaft relative to the tool body. During this relative movement, power transmission from the drive shaft to the driven shaft is maintained via the Oldham's coupling. The elastic element absorbs the movement of the driven shaft relative to the tool body.

10 Claims, 5 Drawing Sheets

ROTARY TOOL

BACKGROUND OF THE INVENTION

1. Field of the Invention

The invention relates to a hand-held rotary tool that reduces vibration caused in a tool body when a tool bit is rotationally driven.

2. Description of the Related Art

Japanese non-examined laid-open Patent Publication No. 1987-74564 discloses a vibration-proofing device for a hand-held power tool in the form of a disc grinder. In the above-mentioned known vibration-proofing device, a gear housing which houses a mechanism for driving a tool bit in the form of a grinding wheel, and a motor housing which houses a motor for driving the grinding wheel and has a grip to be held by a user are connected to each other by an elastic element. When the grinding wheel is driven and vibration is caused in the gear housing, the elastic element serves to reduce transmission of this vibration to the grip via the motor housing.

The above-described known vibration-proofing device is designed such that the motor housing is allowed to move in all directions relative to the gear housing by the elastic element. Therefore, during operation, the grip and the gear housing (the grinding wheel) are irregularly displaced in all directions relative to each other, so that usability decreases. In this point, further improvement is desired.

SUMMARY OF THE INVENTION

Accordingly, it is an object of the invention to provide a hand-held rotary tool which can offer improved usability while realizing reduction of vibration of a tool body.

In order to solve the above-described problem, according to a preferred embodiment of the invention, the rotary tool has a tool body, a drive shaft disposed in the tool body, a driven shaft to which a tool bit is attached, an Oldham's coupling which is disposed between the drive shaft and the driven shaft and transmits rotation of the drive shaft to the driven shaft, and an elastic element disposed between the driven shaft and the tool body. The "rotary tool" according to the invention typically represents a grinder that performs a polishing/grinding operation on a workpiece by rotationally driving the tool bit in the form of a grinding wheel.

According to a preferred embodiment of the invention, the driven shaft is prevented from moving in a longitudinal direction of the driven shaft relative to the tool body and allowed to move in a direction transverse to the longitudinal direction of the driven shaft relative to the tool body. During this relative movement, power transmission from the drive shaft to the driven shaft is maintained via the Oldham's coupling. Further, the elastic element absorbs the movement of the driven shaft relative to the tool body.

When the tool bit is rotationally driven, vibration is mainly caused in a direction transverse to a rotation axis of the tool bit, and little or no vibration is caused in the direction of the rotation axis. According to the invention, the driven shaft to which the tool bit is attached is allowed to move only in the direction transverse to the longitudinal direction relative to the tool body and this relative movement is absorbed by the elastic element. With such a construction, when the tool bit is driven and vibration is mainly caused in the direction transverse to the longitudinal direction of the driven shaft, transmission of this vibration to the tool body can be reduced. Further, the direction of movement of the driven shaft relative to the tool body is limited to one direction, so that the driven shaft and the tool body can be avoided from irregularly moving relative to each other during operation. Therefore, usability in performing an operation while holding the tool body or the grip which is formed on or connected to the tool body can be improved.

Particularly, in this invention, with the construction in which the elastic element is disposed between the driven shaft and the tool body, the tool body can have a large mass ratio with respect to the driven shaft on the vibration source side, so that the vibration reducing effect can be enhanced. Further, the drive shaft and the driven shaft are connected to each other by the Oldham's coupling, so that regardless of relative movement of the driven shaft in a direction transverse to the longitudinal direction, rotation of the drive shaft can be smoothly transmitted to the driven shaft.

According to a further embodiment of the invention, the rotary tool further has an intermediate shaft and a speed reducing part. The intermediate shaft extends in the same direction as the driven shaft and is mounted to the tool body in such a manner as to be prevented from moving in any direction other than a direction of rotation relative to the tool body, and transmits rotation of the drive shaft to the driven shaft via the Oldham's coupling. The speed reducing part transmits rotation of the drive shaft to the intermediate shaft at reduced speed. Further, the "speed reducing part" in the invention typically comprises a driving gear that is rotated by the drive shaft and a driven gear that is engaged with the driving gear and transmits rotation to the intermediate shaft.

According to the invention, with the construction in which the Oldham's coupling is disposed between the intermediate shaft and the driven shaft which are located downstream from the speed reducing part, the Oldham's coupling is driven at reduced speed. Therefore, this construction is effective in improving durability compared with a construction in which the Oldham's coupling is driven at high speed without speed reduction (at an upstream position from the speed reducing part).

According to a further embodiment of the invention, the driven shaft and the drive shaft are disposed such that their axes extend transversely to each other.

According to this invention, with the above-described construction, an angle type rotary tool can be provided in which the tool bit is disposed in the front end region of the tool body in the longitudinal direction such that the direction of the rotation axis of the tool bit is perpendicular to the longitudinal direction of the tool body.

According to a further embodiment of the invention, the driven shaft and the drive shaft are disposed such that their axes extend transversely to each other, and a rotation transmitting region for transmitting rotation from the drive shaft to the intermediate shaft in the speed reducing part is disposed on the opposite side of the axis of the drive shaft from the driven shaft. Further, the "rotation transmitting region" represents a region in which the two gears are engaged with each other, provided that the speed reducing part is formed by the driving gear and the driven gear.

According to this invention, with the construction as described above, compared with a construction in which the rotation transmitting region is disposed on the driven shaft side of the axis of the drive shaft, increase of the distance from the rotation axis of the drive shaft to the tool bit can be prevented.

According to a further embodiment of the invention, the elastic element is annularly disposed all around the driven shaft.

According to this invention, with the above-described construction, the elastic element can seal off a clearance between the outer circumferential surface of the driven shaft and the tool body and can prevent dust produced by operation from entering the inside of the tool body. Specifically, the elastic element can serve not only as a vibration absorbing member but also as a sealing member.

According to a further embodiment of the invention, the tool bit is a grinding wheel. According to this invention, a grinder can be provided which can reduce vibration caused in the tool body when the tool bit is rotationally driven and offer higher usability.

According to the invention, a hand-held rotary tool is provided which can effectively offer improved usability while realizing reduction of vibration of a tool body. Other objects, features and advantages of the invention will be readily understood after reading the following detailed description together with the accompanying drawings and the claims.

DETAILED DESCRIPTION OF THE INVENTION

Figure 1:
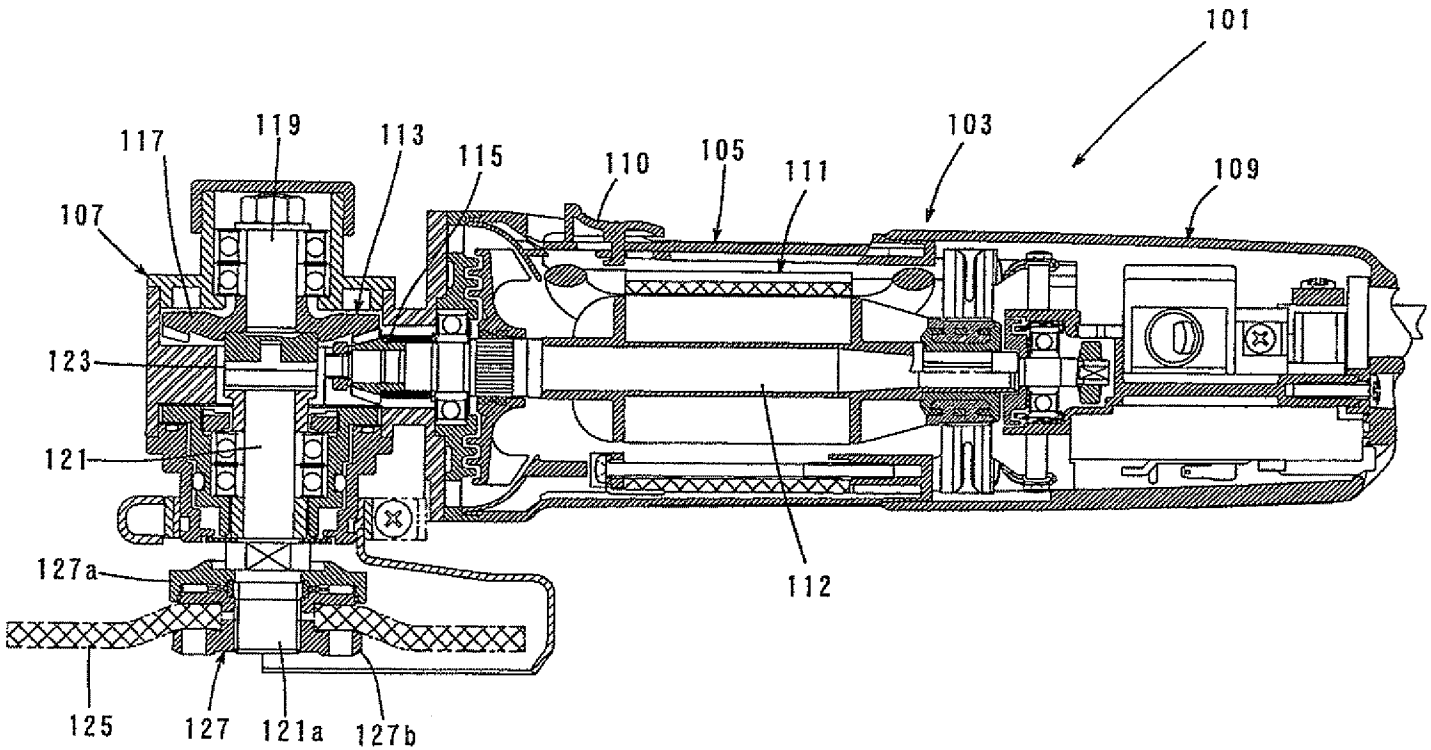
FIG. 1 is a sectional view showing an entire structure of an electric disc grinder according to a first embodiment.

Each of the additional features and method steps disclosed above and below may be utilized separately or in conjunction with other features and method steps to provide and manufacture improved rotary tools and method for using such rotary tools and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

A first embodiment of the invention is now described with reference to FIGS. 1 to 3. In this embodiment, an electric disc grinder 101 is explained as a representative example of a hand-held rotary tool according to the invention. The electric disc grinder (herein after referred to as the disc grinder) 101 mainly includes a body 103 that forms an outer shell of the disc grinder 101, and a disc-like grinding wheel 125 that is disposed in a front end region of the body 103. The body 103 mainly includes a motor housing 105 and a gear housing 107. The body 103 and the grinding wheel 125 are features that correspond to the "tool body" and the "tool bit", respectively, according to this invention. For the sake of convenience of explanation, the grinding wheel 125 side in a longitudinal direction of the body 103 is taken as the front and its opposite side as the rear.

Figure 2:
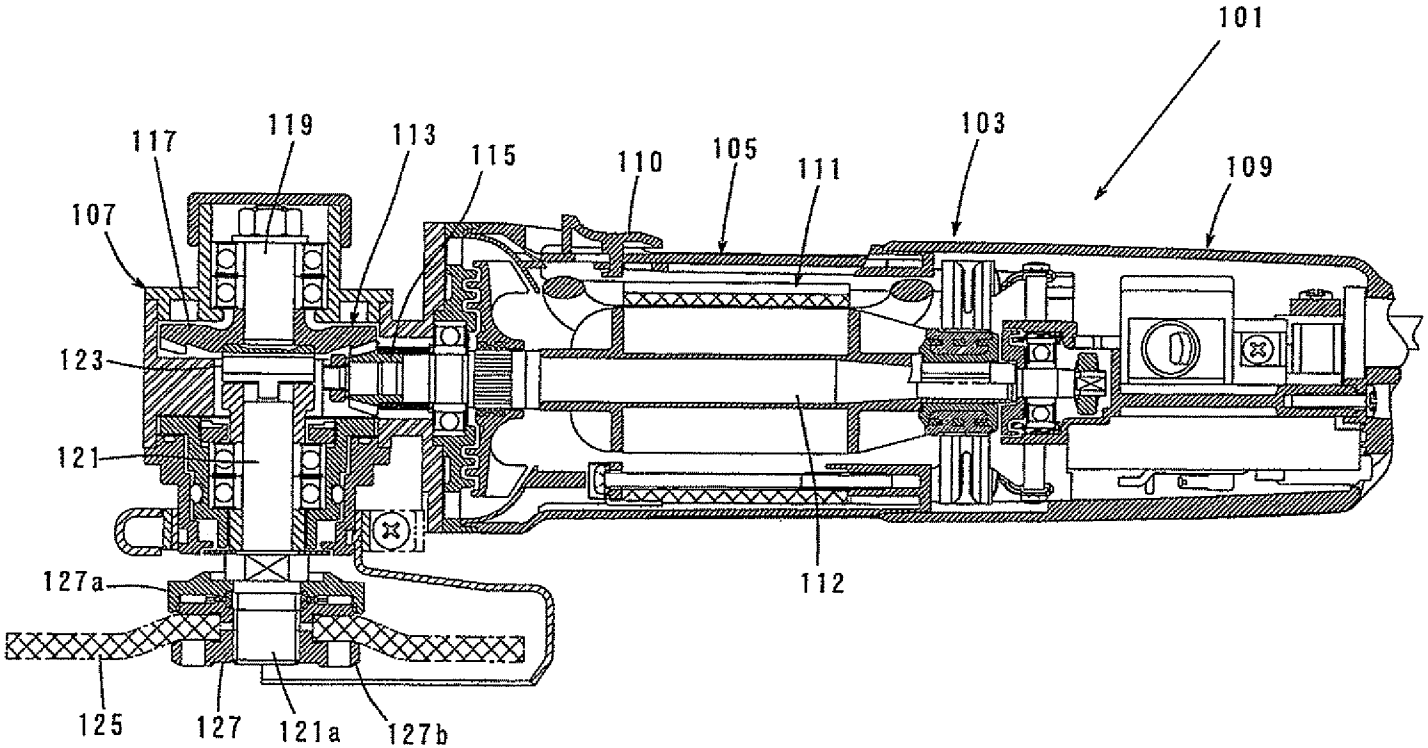
FIG. 2 is a view similar to FIG. 1, but showing a different section of an Oldham's coupling shown in FIG. 1.

FIGS. 1 and 2 show the internal structure of the disc grinder 101. As shown in FIGS. 1 and 2, the motor housing 105 has a generally cylindrical shape and houses a driving motor 111 in its internal space. The driving motor 111 of this embodiment is electrically driven by power supply (from a wall socket) via a power cord and disposed such that its rotation axis extends in parallel to the longitudinal direction of the disc grinder 101 or the longitudinal direction of the body 103. Further, a generally cylindrical rear cover 109 is connected to a rear end (a right end as viewed in the drawings) of the motor housing 105. The motor housing 105 and the rear cover 109 are designed and provided such that their longitudinal axes extend in the longitudinal direction of the body 103. An outer surface of the motor housing 105 and an outer surface of the rear cover 109 form a main handle in the form of a grip designed to be held by a user.

The gear housing 107 is connected to a front end of the motor housing 105 and houses a power transmitting mechanism 113 that transmits rotating output of the driving motor 111 to the grinding wheel 125. The power transmitting mechanism 113 is provided on a front end of a motor shaft 112 and mainly includes a driving-side gear in the form of a small bevel gear 115 which is rotationally driven in a vertical plane, a driven-side gear in the form of a large bevel gear 117 which is engaged with the small bevel gear 115 and rotationally driven in a horizontal plane, an intermediate shaft 119 which is caused to rotate together with the large bevel gear 117, a spindle 121 to which the grinding wheel 125 is attached, and an Oldham's coupling 123 which transmits rotation of the intermediate shaft 119 to the spindle 121.

The disc grinder 101 is of an angle type in which the intermediate shaft 119, the Oldham's coupling 123 and the spindle 121 are disposed substantially perpendicularly to the longitudinal direction of the body 103, so that the rotation axis of the grinding wheel 125 extends in a direction transverse to the longitudinal direction of the body 103. The motor shaft 112 of the driving motor 111, the spindle 121, the intermediate shaft 119 and the Oldham's coupling 123 are features that correspond to the "drive shaft", the "driven shaft", the "intermediate shaft" and the "Oldham's coupling", respectively, according to this invention.

One (lower) end of the vertically extending spindle 121 in its extending direction (axial direction) protrudes a predetermined length from a lower surface of the gear housing 107 to the outside, and this protruding end is designed as a grinding wheel mounting part 121*a* for mounting the grinding wheel 125. The grinding wheel 125 is removably attached to the grinding wheel mounting part 121*a* by a tool holder 127 which consists of two inner and outer flange members 127*a*, 127*b* opposed to each other, and the grinding wheel 125 rotates together with the spindle 121.

Figure 3:
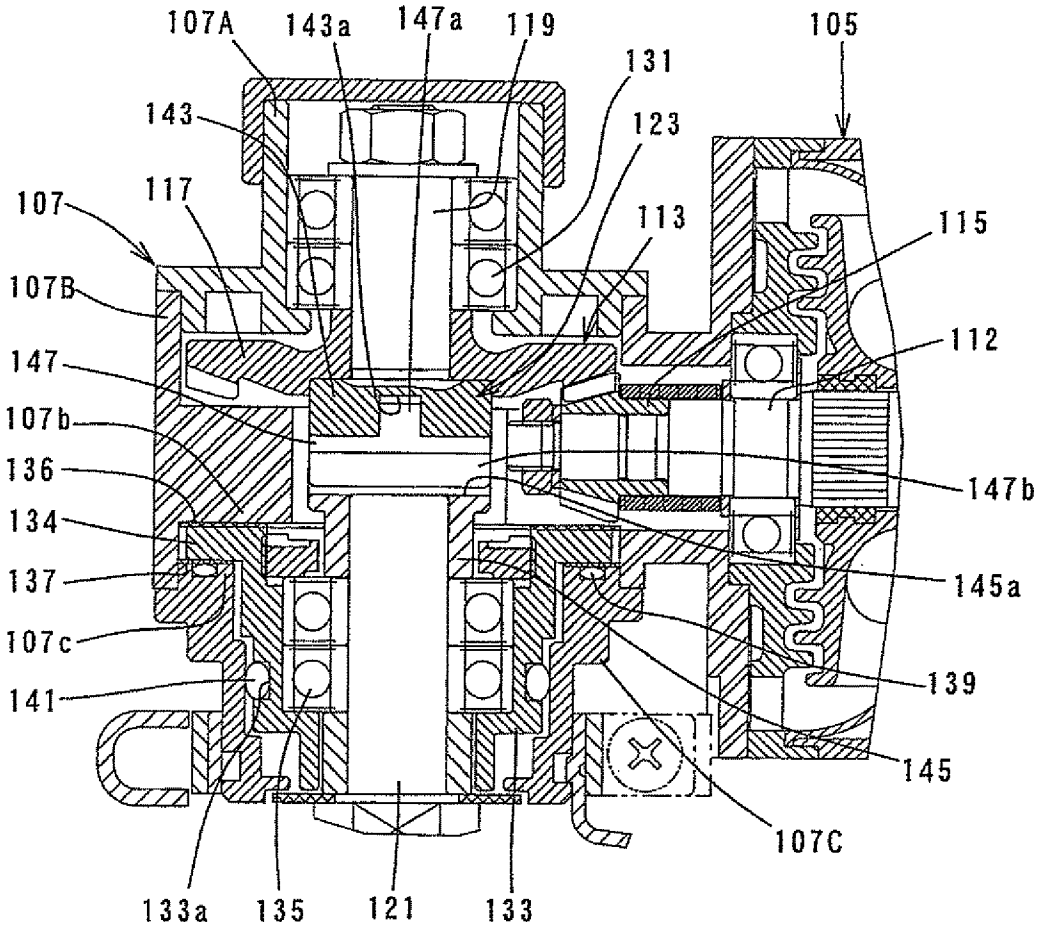
FIG. 3 is an enlarged sectional view showing an essential part of the grinder.

As shown in FIG. 3, the gear housing 107 consists of an upper housing part 107A, a middle housing part 107B and a lower housing part 107C by dividing in the vertical direction into three parts. The middle housing part 107B is disposed between the upper and lower housing parts 107A, 107C and in this state, the upper and lower housing parts 107A, 107C are connected to the middle housing part 107B by fastening screws (not shown) or other fastening means. Further, a rear end of the middle housing part 107B is connected to a front end of the motor housing 105 by fastening screws (not shown) or other fastening means, so that the gear housing 107 is mounted to the motor housing 105.

The intermediate shaft 119 is rotatably supported by the upper housing part 107A via a bearing (ball bearing) 131 and prevented from moving in any direction other than the direction of rotation relative to the upper housing part. The large bevel gear 117 is fixed to a lower end portion of the intermediate shaft 119 such that it can rotate together with the intermediate shaft. The large bevel gear 117 engaged with the small bevel gear 115 is rotationally driven at speed reduced at a predetermined speed reduction ratio. An area of engagement between the small bevel gear 115 and the large bevel gear 117 is a feature that corresponds to the "speed reducing part" according to this invention.

The spindle 121 is rotatably supported by a bearing (ball bearing) 135 which is housed and held in a bearing cover 133. The bearing cover 133 is a generally cylindrical member having a circular flange 134 which extends outward from one axial end (upper end) of the bearing cover. Further, the bearing cover 133 is held and supported in the vertical direction between the middle housing part 107B and the lower housing part 107C. Specifically, an inner lower end of the middle housing part 107B and an inner upper end of the lower housing part 107C are designed as cover support parts 107*b*, 107*c*, respectively. Further, washers 136, 137 are disposed between a lower surface of the cover support part 107*b* of the middle housing part and an upper surface of the flange 134, and between an upper surface of the cover support part 107*c* of the lower housing part and a lower surface of the flange 134, respectively. The washers 136, 137 provide for easy sliding of the bearing cover. By provision of the washers, the bearing cover 133 is prevented from moving in the axial direction (vertical direction) relative to the gear housing 107 and allowed to move in a direction (radial direction) transverse to the axial direction relative to the gear housing 107.

In order to allow the above-described relative movement, a predetermined clearance is formed between an outer peripheral surface of the bearing cover 133 including the flange 134 and an inner surface of the lower housing part 107C, in a direction (radial direction) transverse to the axial direction. Further, a rubber ring 139 is elastically disposed between an upper surface of the cover support part 107*c* of the lower housing part and the washer 137, so that a manufacturing or assembling error in the axial direction can be accommodated.

A cushioning member in the form of an O-ring 141 is disposed between the outer surface of the bearing cover 133 and the inner surface of the lower housing part 107C, and the O-ring 141 serves as a cushioning against the movement of the bearing cover 133 relative to the lower housing part 107C. Specifically, the spindle 121 is elastically supported in the radial direction with respect to the gear housing 107. The O-ring 141 is a feature that corresponds to the "elastic element" according to this invention. Further, the O-ring 141 is fitted in an annular groove 133*a* having a rectangular section and formed in the outer peripheral surface of the bearing cover 133.

The Oldham's coupling 123 mainly includes a disc-like driving member 143 which is integrally formed on a lower end of the intermediate shaft 119, a cylindrical driven member 145 which is press-fitted onto an upper end portion of the spindle 121 and rotates together with the spindle, and a disc-like intermediate member 147 disposed between these members 143, 145. The intermediate member 147 has a first key 147*a* and a second key 147*b*. The first key 147*a* is formed on one axial end surface of the intermediate member 147 and extends radially through the center of the axis of the intermediate member 147, and the second key 147*b* is formed on the other axial end surface and extends perpendicularly to the first key 147*a* through the center of the axis. The first key 147*a* is slidably engaged with a keyway 143*a* formed in the axial end surface (disc end surface) of the driving member 143 and the second key 147*b* is slidably engaged with a keyway 145*a* formed in the axial end surface (cylinder end surface) of the driven member 145. With this construction, even when the rotation axes of the intermediate shaft 119 and the spindle 121 are not in radial alignment, torque can be properly transmitted from the intermediate shaft 119 to the spindle 121.

The disc grinder 101 according to this embodiment is constructed as described above. Therefore, when a user holds the grip with the hand and operates a switch knob 110 for a power switch mounted on the grip, the driving motor 111 is driven and the grinding wheel 125 is rotationally driven via the power transmitting mechanism 113, so that a grinding or polishing operation, a cutting operation or other similar operation can be performed on a workpiece.

In the above-described operation, when the spindle 121 is caused to vibrate by driving of the grinding wheel 125 or by the operation of the grinding wheel 125 on the workpiece, the O-ring 141 can reduce transmission of vibration to the motor housing 105 side via the gear housing 107. Specifically, according to this embodiment, with the construction in which the spindle 121 is mounted to the gear housing 107 such that it is allowed to move in the radial direction relative to the gear housing and elastically supported by the O-ring 141, although the spindle 121 is caused to vibrate mainly in a direction (radial direction) transverse to the longitudinal direction during operation, this vibration in the radial direction can be absorbed by the O-ring 141 so that transmission of vibration to the gear housing 107 can be reduced.

Particularly, in this embodiment, the spindle 121 which is a final output shaft of the power transmitting mechanism 113, or more particularly, the bearing cover 133 of the bearing 135 which rotatably supports the spindle 121, is elastically supported via the O-ring 141 with respect to the gear housing 107. With such a construction, the mass ratio of the non-vibration side body 103 to the vibration side spindle 121, bearing 135 and bearing cover 133 can be increased, so that the vibration reducing effect can be enhanced.

With the construction in which the direction of movement of the spindle 121 relative to the gear housing 107 (the body 103) is limited to one direction (radial direction), the spindle 121 can be avoided from irregularly moving relative to the body 103 during operation. Therefore, when the user holds the grip (outer surface regions of the motor housing 105 and the rear cover 109) formed on the body 103 and performs an operation, the usability (ease of use) of the disc grinder can be enhanced. Further, by provision of the Oldham's coupling 123 which connects the intermediate shaft 119 and the spindle 121, torque of the intermediate shaft 119 can be smoothly transmitted to the spindle 121 while the spindle 121 is allowed to move in the radial direction relative to the gear housing 107.

In this embodiment, the Oldham's coupling 123 is disposed downstream from the speed reducing part in the power transmission path, so that the Oldham's coupling 123 is driven at reduced speed. Specifically, a sliding part (between the keyways 143*a*, 145*a* and the associated keys 147*a*, 147*b*) of the Oldham's coupling 123 is slid at reduced speed, which is effective in improving durability.

In this embodiment, the area of engagement between the small bevel gear 115 and the large bevel gear 117 in which torque of the motor shaft 112 is transmitted to the intermediate shaft 119 at reduced speed is provided on the opposite side of the axis (above the axis) of the motor shaft 112 from the spindle 121. For example, if the area of engagement is provided on the spindle 121 side of the axis (below the axis) of the motor shaft 112, the distance from the rotation axis of the driving motor 111 to the grinding wheel 125 may increase. According to this embodiment, however, with the above-described construction, the distance from the rotation axis of the driving motor 111 to the grinding wheel 125 can be prevented from increasing. The above-described area of engagement is a feature that corresponds to the "rotation transmitting region" according to the invention.

In this embodiment, the O-ring 141 forms the elastic element for elastically supporting the spindle 121 and seals off a clearance between the inner peripheral surface of the gear housing 107 and the outer peripheral surface of the bearing cover 133 over the whole area in the circumferential direction. Therefore, the O-ring 141 serves as a sealing member that prevents dust produced by operation from entering the internal space of the gear housing 107.

(Second Embodiment of the Invention)

Figure 4:
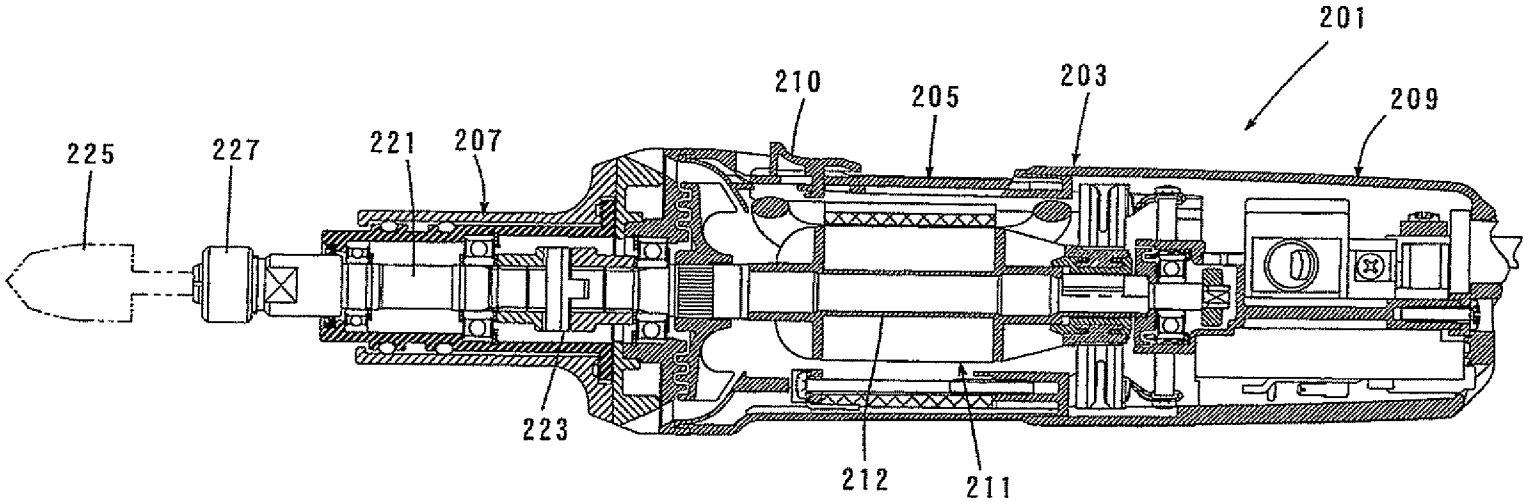
FIG. 4 is a sectional view showing an entire structure of a grinder according to a second embodiment.

A second embodiment of the invention is now described with reference to FIGS. 4 and 5. As shown in FIG. 4, this embodiment covers a grinder 201 in which the rotation axes of a driving motor 211 and a grinding wheel 225 are linearly aligned. In the grinder 201, like the first embodiment, a body 203 includes a motor housing 205 that houses the driving motor 211, a gear housing 207 that is connected to a front end of the motor housing 205 and houses a spindle 221 and an Oldham's coupling 223, and a rear cover 209 that is connected to a rear end of the motor housing 205. An outer surface of the motor housing 205 and an outer surface of the rear cover 209 form a grip designed to be held by a user. The body 203 is a feature that corresponds to the "tool body" according to this invention.

A motor shaft 212 of the driving motor 211 and the spindle 221 are linearly connected to each other via the Oldham's coupling 223 and the rotating output of the driving motor 211 is transmitted to the spindle 221 without reducing speed. The motor shaft 212, the spindle 221 and the Oldham's coupling 223 are features that correspond to the "drive shaft", the "driven shaft" and the "Oldham's coupling", respectively, according to this invention.

Figure 5:
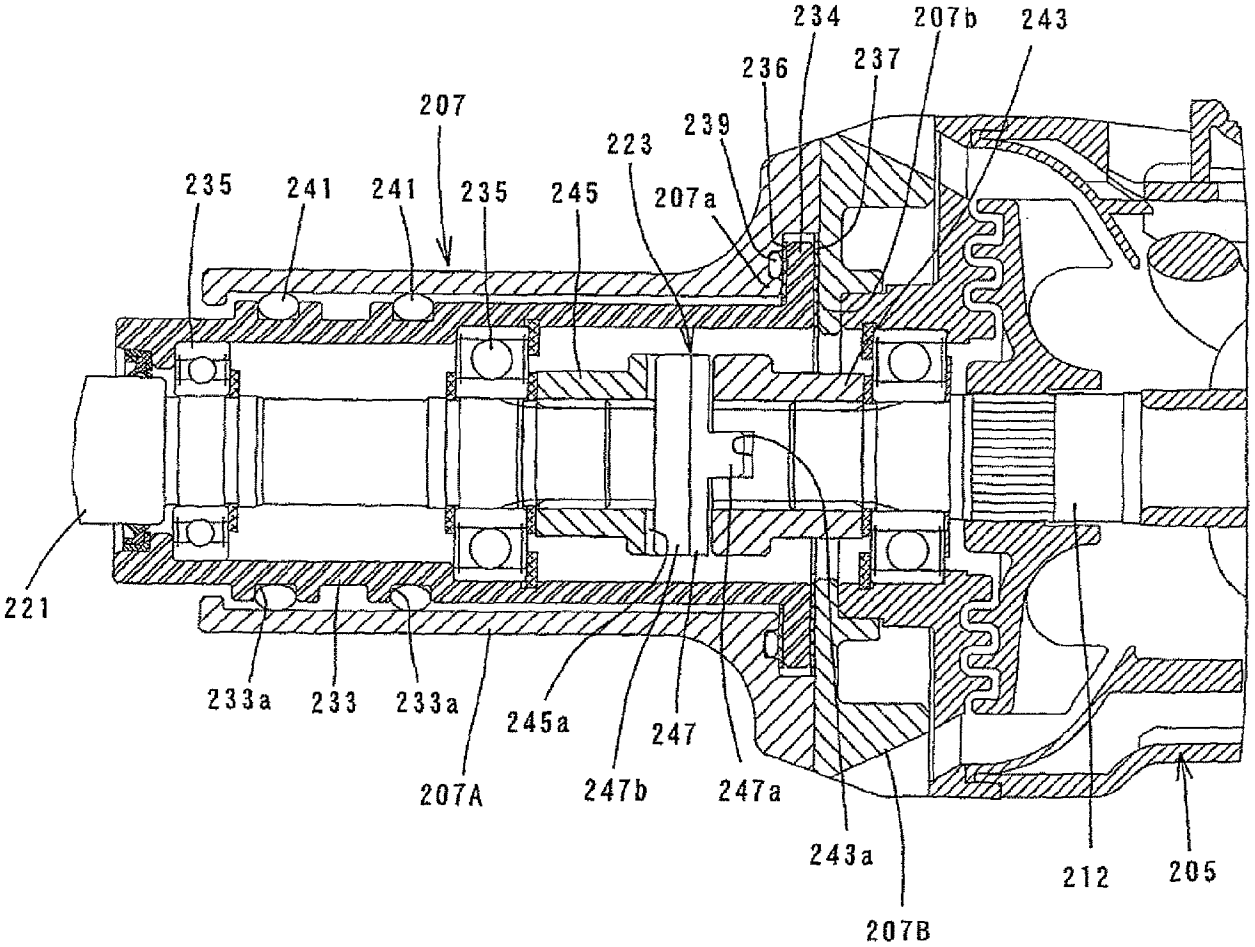
FIG. 5 is an enlarged sectional view showing an essential part of the grinder.

As shown in FIG. 5, the Oldham's coupling 223 is provided as a power transmitting member for transmitting rotating output of the driving motor 211 to the spindle 221, and has a driving member 243 spline-fitted onto a front end region of the motor shaft 212, a driven member 245 spline-fitted onto a rear end region of the spindle 221, and an intermediate member 247 disposed between the two members 243, 245. The intermediate member 247 has a first key 247*a* and a second key 247*b*. The first key 247*a* is formed on one axial end surface of the intermediate member 247 and extends radially through the center of the axis of the intermediate member 247, and the second key 247*b* is formed on the other axial end surface and extends perpendicularly to the first key 247*a* through the center of the axis. The first key 247*a* is slidably engaged with a keyway 243*a* formed in the axial end surface (disc end surface) of the driving member 243 and the second key 247*b* is slidably engaged with a keyway 245*a* formed in the axial end surface (cylinder end surface) of the driven member 245. With such a construction, even when the rotation axes of the motor shaft 212 and the spindle 221 are not in radial alignment, torque can be smoothly transmitted from the motor shaft 212 to the spindle 221.

The spindle 221 is rotatably supported at two points in the longitudinal direction by front and rear bearings (ball bearings) 235. Further, one axial end (front end) of the spindle 221 protrudes a predetermined length forward from a front end of the gear housing 207, and the grinding wheel 225 having a generally conical shape is removably attached to this protruding end via a tool holder 227. The grinding wheel 225 is a feature that corresponds to the "tool bit" according to this invention.

A bearing cover 233 for housing the front and rear bearings 235 is configured as a generally cylindrical member having a flange 234 which extends radially outward from one axial end (rear end) of the bearing cover. The gear housing 207 consists of a generally cylindrical front housing part 207A and a generally annular rear housing part 207B connected to the front housing part 207A. The flange 234 of the bearing cover 233 is held and supported in the longitudinal direction in a connecting region between the front and rear housing parts 207A, 207B. Specifically, an inner rear end of the front housing part 207A and an inner front end of the rear housing part 207B are designed as cover support parts 207*a*, 207*b*, respectively. Further, washers 236, 237 are disposed between a rear surface of the cover support part 207*a* of the front housing part and a front surface of the flange 234, and between a front surface of the cover support part 207*b* of the rear housing part and a rear surface of the flange 234, respectively. The washers 236, 237 provide for easy sliding of the bearing cover. By provision of the washers, the bearing cover 233 is prevented from moving in the axial direction (the horizontal direction as viewed in FIG. 5) relative to the gear housing 207 and allowed to move in a direction (radial direction) transverse to the axial direction relative to the gear housing.

In order to allow the above-described relative movement, a predetermined clearance is formed between an outer peripheral surface of the bearing cover 233 including the flange 234 and an inner surface of the front housing part 207A, in a direction (radial direction) transverse to the axial direction. Further, a rubber ring 239 is elastically disposed between a rear surface of the cover support part 207*a* of the front housing part and the washer 236, so that a manufacturing or assembling error in the axial direction can be accommodated.

Elastic elements in the form of a plurality of (two front and rear) O-rings 241 are disposed between the outer surface of the bearing cover 233 and the inner surface of the front housing part 207A, and each of the O-rings 241 serves as a cushioning against the movement of the bearing cover 233 relative to the front housing part 207A. Specifically, the spindle 221 is elastically supported in the radial direction with respect to the gear housing 207. The O-ring 241 is a feature that corresponds to the "elastic element" according to this invention. Further, the O-ring 241 is fitted in an annular groove 233*a* having a rectangular section and formed in the outer peripheral surface of the bearing cover 233.

The grinder according to this embodiment is constructed as described above. Therefore, when a user holds the grip with the hand and operates a switch knob 210 for a power switch mounted on the grip, the driving motor 211 is driven to rotationally drive the grinding wheel 225 together with the spindle 221 via the motor shaft 212 and the Oldham's coupling 223, so that a grinding or polishing operation, a cutting operation or other similar operation can be performed on a workpiece.

In the above-described operation, according to this embodiment, with the construction in which the spindle 221 is mounted to the gear housing 207 such that it is allowed to move in the radial direction relative to the gear housing and elastically supported by the O-rings 241, although the spindle 221 is caused to vibrate in a direction (radial direction) transverse to the longitudinal direction, this vibration in the radial direction can be absorbed by the O-rings 241 so that transmission of vibration to the gear housing 207 can be reduced. In this embodiment, like in the first embodiment, the bearing cover 233 of the bearing 235 which rotatably supports the spindle 221 is elastically supported via the O-rings 241 with respect to the gear housing 207. With such a construction, the mass ratio of the non-vibration side body 203 to the vibration side spindle 221, bearing 235 and bearing cover 233 can be increased, so that the vibration reducing effect can be enhanced.

With the construction in which the direction of movement of the spindle 221 relative to the gear housing 207 (the body 203) is limited to one direction (radial direction), the spindle 221 can be avoided from irregularly moving relative to the body 203 during operation. Therefore, when the user holds the grip (outer surface regions of the motor housing 205 and the rear cover 209) formed on the body 203 and performs an operation, the usability (ease of use) of the disc grinder can be enhanced. Further, with the construction in which the motor shaft 212 and the spindle 221 are connected to each other by the Oldham's coupling 223, torque of the motor shaft 212 can be smoothly transmitted to the spindle 221 while the spindle 221 is allowed to move in the radial direction relative to the gear housing 207.

In this embodiment, the O-ring 241 forms the elastic element for elastically supporting the spindle 221 and seals off a clearance between the inner peripheral surface of the gear housing 207 and the outer peripheral surface of the bearing cover 233 over the whole area in the circumferential direction. Therefore, the O-ring 241 serves as a sealing member that prevents dust produced by operation from entering the internal space of the gear housing 207.

As a modification of the elastic element for elastically supporting the spindle 121 or 221, although not shown, a plurality of spherical or columnar elastic elements can also be used in place of the O-rings 141, 241. Specifically, in such a modification, the spherical or columnar elastic elements are disposed between the outer peripheral surface of the bearing cover 133 or 233 and the inner peripheral surface of the gear housing 107 or 207 at predetermined intervals in the circumferential direction. The elastic elements bias the bearing cover 133 or 233 toward the center such that the rotation axis of the spindle 121 or 221 is placed coaxially with the intermediate shaft 119 or the motor shaft 212. With such a construction, the spindle 121 or 221 is normally held on the same axis as the intermediate shaft 119 or the motor shaft 212.

In view of the above-described aspect of the invention, following features are provided.

(1)

"A rotary tool, comprising:

a tool body, a drive shaft that is provided in the tool body, a driven shaft to which a tool bit is attached, an Oldham's coupling that is disposed between the drive shaft and the driven shaft and transmits rotation of the drive shaft to the driven shaft, and an elastic element that is disposed between the driven shaft and the tool body, wherein:

the driven shaft is prevented from moving in a longitudinal direction of the driven shaft relative to the tool body and allowed to move in a direction transverse to the longitudinal direction of the driven shaft relative to the tool body, and during said relative movement, power transmission from the drive shaft to the driven shaft is maintained via the Oldham's coupling, and the elastic element absorbs the movement of the driven shaft relative to the tool body and thereby reduces transmission of vibration of the driven shaft in a direction transverse to the longitudinal direction of the driven shaft, to the tool body."

(2)

"The rotary tool as defined in any one of claim 1 to 4 or (1), wherein a plurality of the elastic elements are disposed at predetermined intervals in the circumferential direction of the driven shaft"

(3)

"The rotary tool as defined in any one of claims 1 to 4 or (1) and (2), comprising a bearing that rotatably supports the driven shaft, and a bearing cover that houses the bearing, wherein the bearing cover is elastically supported with respect to the tool body by the elastic element."

(4)

"The rotary tool as defined in claim 5, wherein the annularly disposed elastic element comprises an O-ring."

(5)

"The rotary tool as defined in claim 1 or 2, wherein axes of the driven shaft and the drive shaft are disposed on the same axis and connected to each other via the Oldham's coupling."

DESCRIPTION OF NUMERALS

101 electric disc grinder (rotary tool)
103 body (tool body)
103 motor housing
107 gear housing
107A upper housing part
107B middle housing part
107C lower housing part
107*b*, 107*c* cover support part
109 rear cover
110 switch knob
111 driving motor (motor)
112 motor shaft (drive shaft)
113 power transmitting mechanism
115 small bevel gear
117 large bevel gear
119 intermediate shaft
121 spindle (driven shaft)
121*a* grinding wheel mounting shaft
123 Oldham's coupling
125 grinding wheel (tool bit)
127 tool holder
127*a*, 127*b* flange member
131 bearing
133 bearing cover
133*a* annular groove
134 flange
135 bearing
136, 137 washer
139 rubber ring
141 O-ring (elastic element)
143 driving member
143*a* keyway
145 driven member
145*a* keyway
147 intermediate member
147*a* first key
147*b* second key
201 grinder (rotary tool)
203 body (tool body)
205 motor housing
207 gear housing
207A front housing part
207B rear housing part
207*a*, 207*b* cover support part
209 rear cover
210 switch knob
211 driving motor (motor)
212 motor shaft (drive shaft)
221 spindle (driven shaft)
223 Oldham's coupling
225 grinding wheel (tool bit)
227 tool holder
233 bearing cover
233*a* annular groove

234 flange
235 bearing
236, 237 washer
239 rubber ring
241 O-ring (elastic element)
243 driving member
243*a* keyway
245 driven member
245*a* keyway
247 intermediate member
247*a* first key
247*b* second key

The invention claimed is:

1. A rotary tool, comprising:

a tool body, a drive shaft disposed in the tool body, a driven shaft to which a tool bit is attached, the driven shaft being prevented from moving in a longitudinal direction of the driven shaft relative to the tool body, an Oldham's coupling that is disposed between the drive shaft and the driven shaft and transmits rotation of the drive shaft to the driven shaft, an elastic element that is disposed between the driven shaft and the tool body, and a cover that covers the driven shaft, wherein:

a recess is provided at least one of the cover and the tool body, and the elastic element is contained in the recess, the driven shaft is allowed to move in a direction transverse to the longitudinal direction of the driven shaft relative to the tool body, and during the relative movement, power transmission from the drive shaft to the driven shaft is maintained via the Oldham's coupling, and the elastic element absorbs the movement of the driven shaft relative to the tool body in the direction transverse to the longitudinal direction of the driven shaft.

2. The rotary tool as defined in claim 1, further comprising:

an intermediate shaft that extends in the same direction as the driven shaft and is mounted to the tool body in such a manner as to be prevented from moving in any direction other than a direction of rotation relative to the tool body, and transmits rotation of the drive shaft to the driven shaft via the Oldham's coupling, and a speed reducing part that transmits rotation of the drive shaft to the intermediate shaft at reduced speed.

3. The rotary tool as defined in claim 1, wherein the driven shaft and the drive shaft are disposed such that their axes extend transversely to each other.

4. The rotary tool as defined in claim 2, wherein the driven shaft and the drive shaft are disposed such that their axes extend transversely to each other, and a rotation transmitting region for transmitting rotation from the drive shaft to the intermediate shaft in the speed reducing part is disposed on an opposite side of the axis of the drive shaft from the driven shaft.

5. The rotary tool as defined in claim 1, wherein the elastic element is annularly disposed all around the driven shaft.

6. The rotary tool as defined in claim 1, wherein the tool bit comprises a grinding wheel.

7. The rotary tool as defined in claim 1, wherein a plurality of the elastic elements are disposed at predetermined intervals in the circumferential direction of the driven shaft.

8. The rotary tool as defined in claim 1 further comprising a bearing that rotatably supports the driven shaft wherein the cover houses the bearing and is elastically supported with respect to the tool body by the elastic element.

9. The rotary tool as defined in claim 5, wherein the annularly disposed elastic element comprises an O-ring.

10. The rotary tool as defined in claim 1, wherein axes of the driven shaft and the drive shaft are disposed on the same axis and connected to each other via the Oldham's coupling.

* * * * *